US006152084A

United States Patent [19]

Ban et al.

[11] Patent Number: 6,152,084

[45] Date of Patent: Nov. 28, 2000

[54] VISCOUS FLUID TYPE HEAT GENERATOR FILLED WITH REGULATED AMOUNT OF VISCOUS FLUID

[75] Inventors: Takashi Ban; Hidefumi Mori; Kiyoshi Yagi; Tatsuya Hirose, all of Kariya, Japan

[73] Assignee: Kabushiki Kaisha Toyoda Jidoshokki Seisakusho, Kariya, Japan

[21] Appl. No.: 08/876,076

[22] Filed: Jun. 13, 1997

[30] Foreign Application Priority Data

Jun. 17, 1996 [JP] Japan ..... 8-155561

[51] Int. Cl.[7] ..... F22B 3/06

[52] U.S. Cl. ..... 122/26; 126/247

[58] Field of Search ..... 122/26; 126/247

[56] References Cited

U.S. PATENT DOCUMENTS

| | | | |
|---|---|---|---|
| 4,365,614 | 12/1982 | Grover | 122/26 |
| 4,501,231 | 2/1985 | Perkins | 122/26 |
| 4,974,778 | 12/1990 | Bertling | 122/26 |
| 5,573,184 | 11/1996 | Martin . | |
| 5,752,499 | 5/1998 | Mori et al. | 126/247 |
| 5,765,545 | 6/1998 | Ban et al. | 126/247 |

*Primary Examiner*—Denise L. Ferensic
*Assistant Examiner*—Jiping Lu
*Attorney, Agent, or Firm*—Burgess, Ryan & Wayne

[57] ABSTRACT

A viscous fluid type supplementary heat generator having a housing assembly defining a fluid containing chamber including a hermetically sealed heat generating chamber in which a viscous fluid is filled to generate heat when the viscous fluid is subjected to shearing action applied by the rotation of a rotor element rotatably arranged in the heat generating chamber. The fluid containing chamber has a predetermined substantial volume with respect to which the volume of the viscous fluid filled in the fluid containing chamber is set at a value between 50% through 70%, i.e., the filling rate of the viscous fluid relative to the substantial volume of the fluid containing chamber of the viscous fluid type heat generator is determined to be a value between 0.5 through 0.7. The determination of the filling rate of the viscous fluid is made so as to protect an oil sealing device sealing the heat generating chamber from being damaged or broken by an excessive pressure prevailing in the heat generating chamber.

5 Claims, 3 Drawing Sheets

VISCOUS FLUID TYPE HEAT GENERATOR FILLED WITH REGULATED AMOUNT OF VISCOUS FLUID

BACKGROUND OF THE INVENTION

1. Field of the Invention

The present invention relates generally to a viscous fluid type heat generator in which a viscous fluid is filled in a predetermined fluid containing chamber defined within a housing assembly and is subjected to a repeated shearing action by the rotation of a rotor element so as to generate heat which is in turn transmitted to a circulating heat exchanging fluid in a heat receiving chamber. The heat is carried by the heat exchanging fluid to a desired heated area, such as a passenger compartment in an automobile. More particularly, the present invention relates to a viscous fluid type heat generator in which the predetermined fluid containing chamber of the housing assembly is filled with a viscous fluid at filling rate suitable for generating heat of which the temperature is enough to be used with a heating system, while preventing a damage to an oil sealing device incorporated in the viscous fluid type heat generator.

2. Description of the Related Art

It is known to use a viscous fluid type heat generator as a supplementary heating device for motor vehicle heating systems. The supplementary heating device has a drive shaft operationally connected to and driven by a motor vehicle engine. The drive shaft is rotatably supported in a housing assembly which houses a rotor element drivingly connected to an inner end of the drive shaft. The housing assembly defines a heating chamber therein in which a predetermined amount of viscous fluid such as silicone oil is filled so that the viscous fluid is retained in spaces provided between the inner walls of the heat generating chamber and the outer surface of the rotor element. The filling rate of the viscous fluid for the heating chamber is generally set, for example, at higher than 80%, and the heating chamber is hermetically sealed by an oil seal element or a shaft seal element arranged within the heating chamber around the drive shaft so as to prevent leakage of the viscous fluid from the heating chamber.

The application of a fluid filling rate of 80% or more is based on the fact that the conventional viscous coupling device employing the same heat generating principle as the viscous fluid type heat generator has satisfactorily applied this filling rate. In the viscous coupling device, the viscous oil is used as a working medium, and an increase in the volume of the working medium due to frictional heat generation of the working medium is utilized for providing an adjustable fluid coupling between two clutch plates in order to transmit an adjusted torque from the input of the coupling device to the output thereof. Thus, in the viscous coupling device, it is often needed to provide a strong connection substantially corresponding to a direct connection between the two clutch plates so as to transmit a full torque from the input to the output of the coupling device, and accordingly, the filling rate of the viscous fluid must be designed and set at a value as high as possible.

Nevertheless, in the conventional viscous fluid type heat generator, heat generation occurs due to an application of a shearing action to the viscous fluid held between the inner walls of the heat chamber and the outer surfaces of the rotor element by the rotation of the rotor element. The heat generation of the viscous fluid causes an increase in the temperature of the viscous fluid, and therefore, expansion of volume of the viscous fluid as well as the air confined within the heat generating chamber occur. Therefore, an inner pressure prevailing within the heat generating chamber increases depending on an increase in the expansion of the volume of the viscous fluid and the air. When a volume occupied by the viscous fluid within the heat generating chamber is considerably larger than that occupied by the air within the heat generating chamber, namely, when the filling rate of the viscous fluid for the heat generating chamber is large, the inner pressure within the heat generating chamber may excessively increase beyond a predetermined durable pressure (the maximum permissible pressure) for the oil seal, due to a difference in the thermal expansion coefficients of the viscous fluid and the air. As a result, damage to the oil seal and leakage of the viscous fluid from the heat generating chamber might occur.

SUMMARY OF THE INVENTION

An object of the present invention is, therefore, to provide a viscous fluid type heat generator capable of exhibiting good operating reliability for a long operational life causing neither damage to an oil sealing device incorporated therein nor leakage of viscous fluid from a heat generating chamber thereof.

Another object of the present invention is to provide an improved viscous fluid type heat generator having a sufficient and reliable heat generating performance without the addition of structural elements which may cause an increase in the manufacturing cost of the heat generator.

In accordance with the present invention, there is provided a viscous fluid type heat generator which comprises:

- a housing assembly defining therein a fluid containing chamber for containing viscous fluid and a heat receiving chamber for permitting heat exchanging fluid to flow therethrough;
- a drive shaft rotatably supported by the housing assembly and rotationally driven by an external drive source, the drive shaft including a part thereof extending into the housing assembly;
- a rotor element mounted on the part of the drive shaft to be rotated in the fluid containing chamber, the rotation of the rotor element applying a shearing action to the viscous fluid to generate heat;
- a heat transmitting element arranged between the fluid containing chamber and the heat receiving chamber to transmit heat from the viscous fluid to the heat exchanging fluid;
- a sealing element arranged around the drive shaft at a position adjacent to the fluid containing chamber to prevent the viscous fluid from leaking from the fluid containing chamber; and,
- an arrangement wherein the viscous fluid is filled in the fluid containing chamber at a predetermined volumetric filling rate selected from a range between 50% and 70% with respect to an entire volume of the fluid containing chamber.

Preferably, the fluid containing chamber includes a heat generating chamber in which the rotor element and the part of the drive shaft are located, the heat generating chamber being fluid-tightly sealed by the sealing element arranged adjacent to the part of the drive shaft, so that leakage of the viscous fluid over the outer circumference of the drive shaft is prevented. Since the sealing element is protected against breakage or abrasion by the specific arrangement of the filling rate of the viscous fluid into the fluid containing chamber of the heat generator, the operational life of the viscous fluid type heat generator can surely be long.

The rest of volume of the fluid containing chamber of the viscous fluid type heat generator except for the volume filled with the viscous fluid is preferably filled with non-oxidizing gas. The filling of the non-oxidizing gas into the fluid containing chamber permits the air to be purged from the fluid containing chamber, and accordingly, the viscous fluid can be prevented from being oxidized. Thus, the chemical and physical properties of the viscous fluid are maintained unchanged for a long operational life of the heat generator. Therefore, a stable heat generating performance of the viscous fluid type heat generator can be maintained during the operational life of the heat generator.

The non-oxidizing gas can be one of nitrogen gas, carbon dioxide, and a rare gas including helium (He) gas, neon (Ne) gas, and argon (Ar) gas.

In the described viscous fluid type heat generator, even if the viscous fluid within the fluid containing chamber generates heat sufficient for indicating a required high temperature, the content in the fluid containing chamber, i.e., the viscous fluid and the non-oxidizing gas cannot be thermally expanded to have a pressure which is high above a limit of pressure that the sealing element incorporated in the viscous fluid type heat generator can physically endure. Thus, the sealing element is constantly subjected to an allowable pressure, and therefore, the mechanical durability of the sealing element can be maintained for a long operation life.

If the filling rate of the viscous fluid into the fluid containing chamber of the heat generator is larger than 70%, the thermal expansion of the viscous fluid and the gaseous content of the fluid containing chamber causes an increase in the inner pressure within the fluid containing chamber to a high pressure level that the sealing element of the heat generator cannot endure. As a result, a defect may occur in that hermetic sealing of the fluid containing chamber is broken permitting the viscous fluid to leak from the fluid containing chamber.

On the other hand, if the filling rate of the viscous fluid into the fluid containing chamber is less than 50%, the amount of the viscous fluid subjected to the shearing action applied by the rotating rotor element within the fluid containing chamber is insufficient for generating heat to be supplied to the motor vehicle heating system, and accordingly, the heat generating performance of the viscous fluid type heat generator is low.

BRIEF DESCRIPTION OF THE DRAWINGS

The above and other objects, features and advantages of the present invention will be made more apparent from the ensuing description with reference to the accompanying drawings wherein.

DESCRIPTION OF THE PREFERRED EMBODIMENTS

Figure 1:
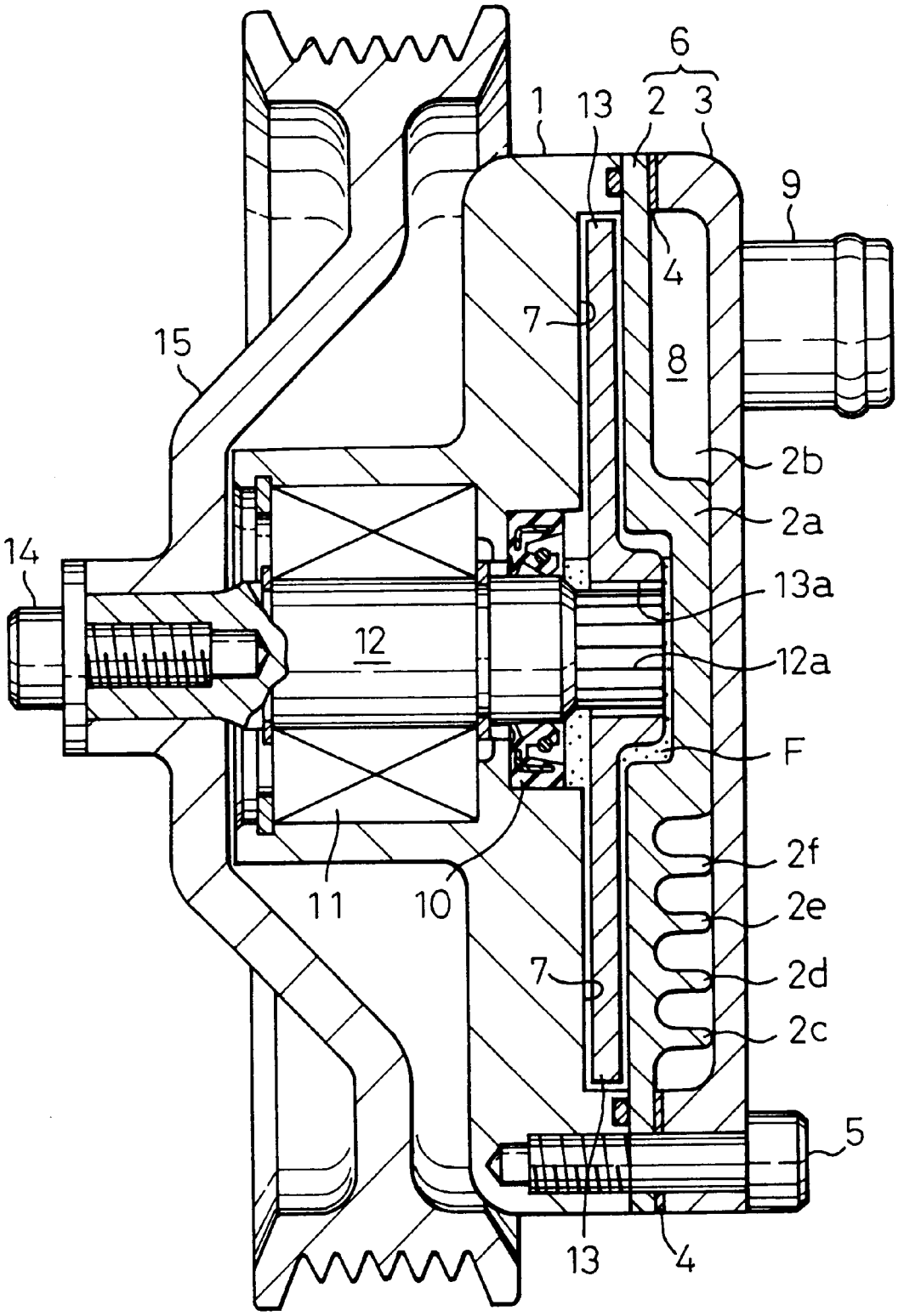
FIG. 1 is a cross-sectional view of a viscous fluid type heat generator according to a first embodiment of the present invention.

Referring to FIG. 1, a viscous fluid type heat generator according to the first embodiment of the present invention includes a housing assembly which is formed by a front housing 1, a separating plate 2, a rear housing body 3, and a sealing gasket 4. The front housing 1, the separating plate 2, the rear housing body 3, and the sealing gasket 4 are arranged to be juxtaposed in relation to one another, and combined together by a plurality of long screw bolts 5 (only one screw bolt 5 is shown in FIG. 1). The separating plate 2 and the rear housing body 3 form a rear housing 6 having a liquid inlet port 9 and a liquid outlet port (not shown in FIG. 1 but arranged in a similar manner to the liquid inlet 9).

The front housing 1 is provided with an inner face which has a large recess formed therein so as to face a front end face of the separating plate 2 and to define a heat generating chamber 7. A rear end face of the separating plate 2 and an inner wall face of the rear housing body 3 define therebetween a heat receiving chamber 8 arranged adjacent to the heat generating chamber 7. The separating plate 2 isolates the heat receiving chamber 8 from the heat generating chamber 7, and acts as a heat transmitting member between the chambers 7 and 8. The heat receiving chamber 8 receives a heat exchanging liquid through the liquid inlet port 9, and delivers the liquid from the outlet port toward an external heating system such as a motor vehicle heating system. The heat exchanging liquid circulates through the heat receiving chamber 8 of the heat generator and the external motor vehicle heating system.

The separating plate 2 is centrally provided with a columnar protrusion 2*a* projecting rearwardly from the separating plate toward the inner end face of the rear housing body 3. The rear end face of the separating plate 2 is provided with a radial wall portion 2*b* formed so as to extend radially from a part of the outer surface of the columnar protrusion 2*a*. The rear end face of the separating plate 2 is further provided with a plurality of fins 2*c* through 2*f* extending circumferentially from a position adjacent to the inlet port 9 toward a position adjacent to the outlet port. The columnar portion 2*a*, the radial wall portion 2*b*, and the plurality of fins 2*c* through 2*f* are kept in contact with the inner end face of the rear housing body 3 so as to form flow passageways for the heat exchanging liquid within the heat receiving chamber 8.

The front housing 1 is centrally provided with a front boss portion in which is housed a bearing device 11 rotatably supporting a drive shaft 12. The drive shaft 12 is provided with a rear part thereof having an axial male spline 12*a* formed therearound and located in the heat generating chamber 7.

A rotor element 13 in the form of a flat plate is mounted on the rear part of the drive shaft 12, and arranged within the heat generating chamber 7 so as to be rotated together with the drive shaft 12. The rotor element 13 has a central hub portion in which a central bore having an axial female spline 13*a* is formed. The female spline 13*a* of the rotor element 13 is engaged with the male spline 12*a* of the drive shaft 12. Namely, the rotor element 13 is axially movable with respect to the rear part of the drive shaft 12 but is not able to-rotationally move with respect to the drive shaft 12. That is, the axial movement of the rotor element 13 with respect to the drive shaft 12 occurs when an axial thrust force is applied to the rotor element 13.

An oil sealing device 10 in the form of an annular seal member is arranged around the drive shaft 12 at a front position of the heat generating chamber 7 so as to hermetically seal the heat generating chamber 7.

When the viscous fluid type heat generator is initially assembled, viscous fluid, e.g., silicone oil "F" is filled into the heat generating chamber 7. If the heat generating chamber 7 incorporating therein the oil sealing device 10, the rear part of the drive shaft 12, and the rotor element 13 has a substantial internal volume "Vt1" thereof before filling of the silicone oil, the volume "VF" of the silicone oil filled into the heat generating chamber 7 should be a value between 50% through 70% relative to the substantial internal volume Vt1 of the heat generating chamber 7. Namely, although the heat generating chamber 7 forms a major part of a fluid containing chamber capable of containing therein the viscous fluid (the silicone oil), anywhere into which the filled viscous fluid may enter should be regarded as a part of the fluid containing chamber. Thus, the filling rate "R" of the viscous fluid to the fluid containing chamber can be defined by an equation as set forth below.

$$R=VF/Vt1$$

The filling rate "R" into the viscous fluid type heat generator of the first embodiment should be set at a value between 50% through 70%, and preferably, be approximately 60% (R=0.60).

It will be understood that the volume of filling "VF" of the viscous fluid (the silicone oil) is considerably smaller than the substantial internal volume "Vt1" of the fluid containing chamber. Nevertheless, since a space between the inner wall faces of the heat generating chamber 7 and the outer surface of the rotor element 13 is very small, as soon as the rotor element 13 starts to rotate, the silicone oil is distributed evenly into all part of the small space between the inner wall faces of the heat generating chamber 7 and the outer surface of the rotor element 13 on the basis of surface tension acting on the silicone oil. Therefore, when the viscous fluid, i.e., the silicone oil is filled into the heat generating chamber 7 at the above-mentioned filling rate "R", the viscous fluid within the heat generating chamber 7 can surely generate heat sufficient to be used with the motor vehicle heating system.

Further, the rest of volume of the fluid containing chamber, i.e., the heat generating chamber 7, which is not filled with the viscous fluid (for example, when the filling rate "R" of the viscous fluid is set at 60%, the rest of volume of the fluid containing chamber is 40% of Vt1) may be filled with the air under the atmospheric pressure. Nevertheless, the rest of the volume of the fluid containing chamber should preferably be filled with non-oxidizing gas such as nitrogen or carbon dioxide, or a rare gas such as helium, neon, argon, etc,. The gas filled in the fluid containing chamber may be filled under a pressure less than the atmospheric pressure, usually 1 atm. pressure.

A pulley 15 is secured to a front end of the drive shaft 12 by a screw bolt 14. The pulley 15 is connected to an external drive source such as a motor vehicle engine via a belt (not shown), and therefore, the drive shaft 12 is rotationally driven by the motor vehicle engine to rotate the rotor element 13 within the heat generating chamber 7. Accordingly, the rotation of the rotor element 13 applies a shearing action to the viscous fluid held between the inner walls of the heat generating chamber 7 and the outer surface of the rotor element 13. Thus, the viscous fluid generates heat which is in turn transmitted to the heat exchanging liquid flowing through the heat receiving chamber 8. The heat exchanging liquid is delivered from the outlet port of the heat generator, and carries the heat to the external motor vehicle heating system which heats up a passenger compartment of the motor vehicle.

Figure 2:
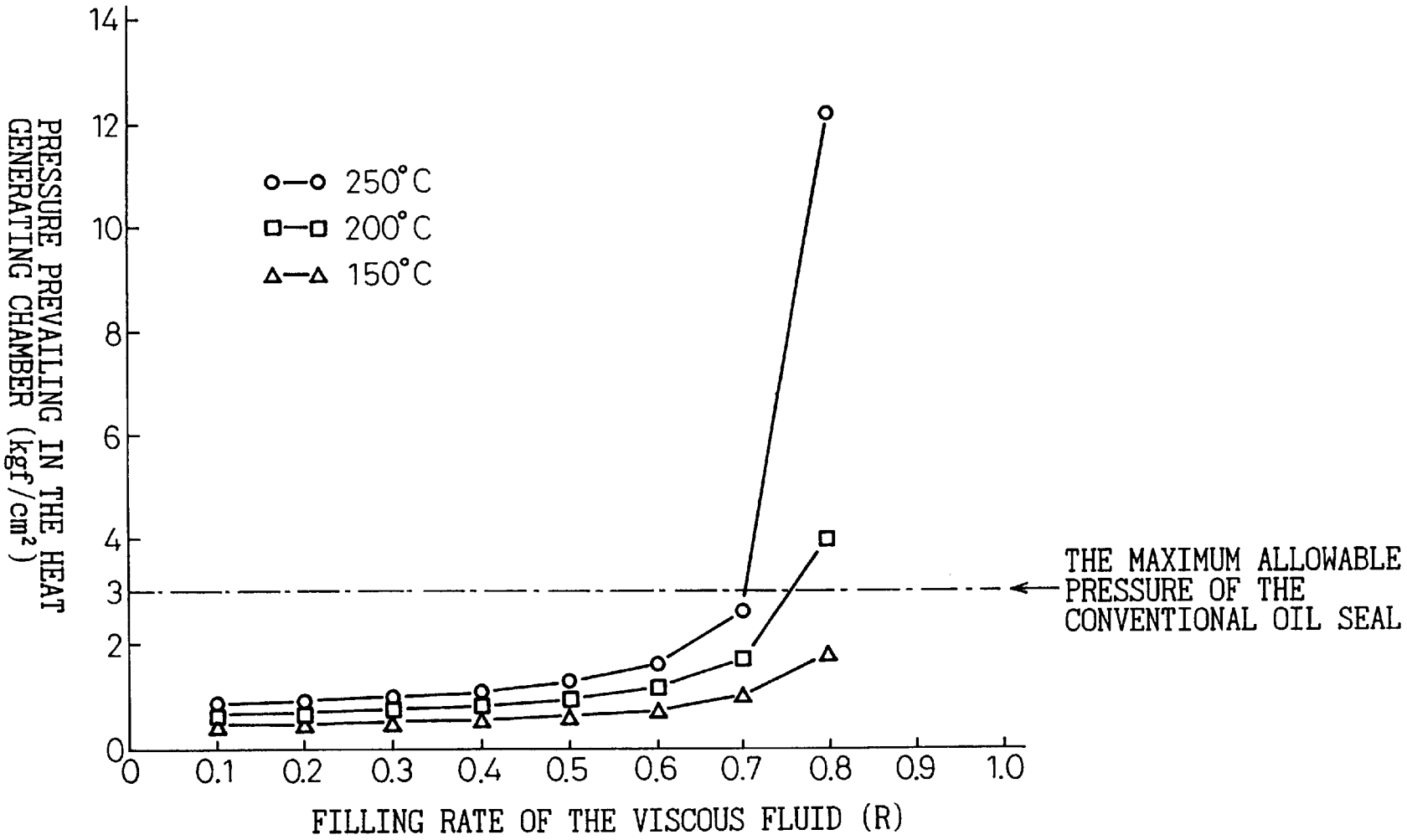
FIG. 2 is a graphical view indicating a relationship between the filling rate of viscous fluid and inner pressure prevailing in the fluid containing chamber; and, FIG. 3 is a cross-sectional view of a viscous fluid type heat generator according to a second embodiment of the present invention.

The graph in FIG. 2 indicates a result of measurements indicating a relationship between the filling rate R of the viscous fluid (the abscissa) and the internal pressure prevailing in the heat generating chamber 7 with respect to various temperatures, due to the heat generation, of the viscous fluid. The temperatures selected for the heat measurement were 150° C., 200° C., and 250° C. In order that the viscous fluid type heat generator can be used as a supplementary heat source for a motor vehicle heating system, the heat generator should preferably generate heat to show a temperature between 200° C. and 250° C. If the temperature of the viscous fluid is less than 150° C., the heat exchanging liquid within the heat receiving chamber 8 can not receive heat sufficient to be used with the motor vehicle heating system. This is because in the motor vehicle heating system, an engine cooling water circulating around the vehicle engine is used as the heat exchanging liquid and, accordingly, the heat exchanging liquid per se may have a relatively high temperature. As a result, if the temperature of the viscous fluid within the heat generating chamber 7 is relatively low, an effective heat transmission from the viscous fluid to the heat exchanging liquid in the heat receiving chamber 8 may not be made due to a small temperature gradient. On the other hand, a viscous fluid which has sufficient thermal durability against a temperature above 250° C. is not easily available and would be very expensive if it were available. Therefore, the viscous fluid type heat generator must be designed so that the temperature obtained by the heat generation of the viscous fluid should be constantly kept lower than 250° C.

From the graph of FIG. 2, it is understood that even in the case where the temperature of the viscous fluid is 250° C., if the filling rate "R" of the viscous fluid is set at a value less than 0.7, the internal pressure "P" in the heat generating chamber 7 is less than 3 $Kgf/cm^2$ which corresponds to the maximum allowable pressure which conventional oil sealing devices can withstand.

The advantages of the viscous fluid type heat generator according to the first embodiment can be set forth below.

(a) The filling rate "R" of the viscous fluid into the heat generating chamber 7 is set at a value below 0.7 (70%). As a result, when the viscous fluid "F" within the heat generating chamber 7 generates heat in response to the rotation of the rotor element 13, the internal pressure prevailing in the heat generating chamber 7 does not go above 3 $Kgf/cm^2$. Therefore, the oil sealing device 10 is neither damaged nor broken. Namely, the oil sealing device 10 can employ a conventional oil sealing device having an average pressure durability of 3 $Kgf/cm^2$ and readily available on the market.

(b) The oil sealing device 10 hermetical sealing the fluid containing chamber which is essentially the heat generating chamber 7 is not subjected to an unreasonable high pressure due to an increase in the internal pressure "P" of the heat generating chamber 7 during the operation of the viscous fluid type heat generator. Therefore, the operational life of the oil sealing device 10 per se can be sufficiently long.

(c) The sealing device 10 can be formed by one of the conventional inexpensive oil sealing devices available on the market. Therefore, the manufacturing cost of the viscous fluid type heat generator per se can be kept low while the operational life of the oil sealing device incorporated thereinto and the operational reliability of the heat generator are improved.

(d) When a non-oxidizing gas such as nitrogen is filled into a portion of the heat generating chamber 7 except for the viscous fluid filled portion thereof, the degradation of the viscous fluid such the silicone oil due to oxidizing at a high temperature can be effectively prevented. Therefore, the chemical and physical property of the silicone oil can be maintained unchanged during a long operational life of the viscous fluid type heat generator. Thus, the heat generating performance of the viscous fluid type heat generator can be maintained stable over a long operational life of the heat generator.

The described viscous fluid type heat generator according to the first embodiment of the present invention may be modified in a manner as set forth below.

(1) A solenoid clutch may be arranged between the pulley 15 and the drive shaft 12 of the heat generator, so that a drive power from the vehicle engine can be transmitted to the drive shaft 12 via the solenoid clutch. Thus, transmission of the drive power from the external drive source to the viscous fluid type heat generator can be controlled by an externally applied control signal.

Figure 3:
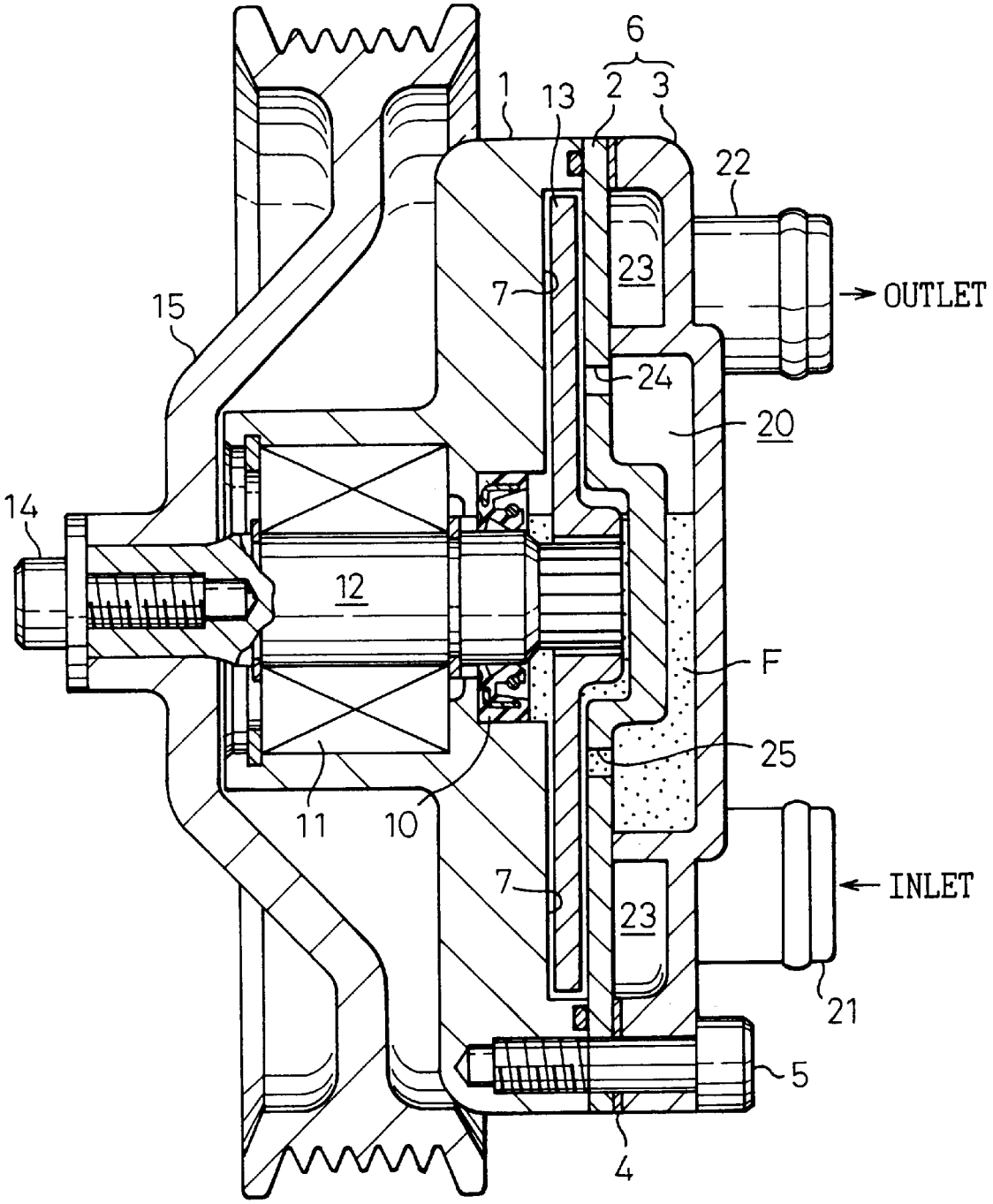

FIG. 3 illustrates the second embodiment of the present invention. The viscous fluid type heat generator of the second embodiment shown in FIG. 1 is different from the heat generator of the first embodiment of FIG. 2 in that an additional subsidiary fluid containing chamber 20 working as a fluid reservoir is arranged adjacent to the heat generating chamber 7 so as to store the viscous fluid F therein. The subsidiary fluid containing chamber 20 is defined between the rear end face of the separating plate 2 and the rear housing body 3, and a heat receiving chamber 23 having the same function as the chamber 8 of the first embodiment of FIG. 1 is arranged around the subsidiary fluid containing chamber 20. An inlet port 21 and an outlet port 22 are provided for the heat receiving chamber 23 for the introduction of the heat exchanging liquid to the chamber 23 and delivery of the heat exchanging liquid from the chamber 23.

The separating plate 2 of the rear housing 6 is provided with a fluid withdrawing aperture 24 and a fluid supplying aperture 25 formed therein. These apertures 24 and 25 are provided for communicating the heat generating chamber 7 with the subsidiary fluid containing chamber 20. Namely, in the viscous fluid type heat generator of the second embodiment of the present invention, the fluid containing chamber for containing the viscous fluid "F" is formed by the heat generating chamber 7 and the subsidiary fluid containing chamber 20.

When the substantial internal volume of the heat generating chamber 7 containing therein the oil sealing device 10, the rear end of the drive shaft 12, and the rotor element 13 is referred to as "Vt1" before the filling of the viscous fluid, the total volume of the subsidiary fluid containing chamber 20 and the two apertures 24 and 25 is-referred to as "Vt2", and the volumetric amount of the viscous fluid filled into the heat generating chamber 7 and the subsidiary fluid containing chamber 20 is referred to as VF2, the filling rate "R" of the viscous fluid can be defined by an equation as set forth below.

$$R=VF2/(Vt1+Vt2)$$

When the filling rate "R" of the viscous fluid into the viscous fluid type heat generator according to the second embodiment is set at a value between 0.5 and 0.7, the heat generator can similarly enjoy the above-mentioned advantages (a) through (d).

It should be understood that the fluid containing chamber of the heat generator of the second embodiment is formed by the heat generating chamber 7, the subsidiary fluid containing chamber 20, and all other cavities and apertures into which the viscous fluid may enter.

From the foregoing description of the preferred embodiments of the present invention, it will be understood that according to the present invention, the viscous fluid heat generator can improve the operational reliability and the operation life thereof.

The viscous fluid referred to throughout the specification of the present application is not limited to the described silicone oil. All kinds of fluid medium capable of frictionally generating heat due to application of shearing action may be used with the viscous fluid type heat generator of the present invention. Further, many modifications and variations will occur to the persons skilled in the art without departing from the scope and spirit of the present invention defined by the accompanying claims.

What is claimed is:

1. A method for generating heat with a viscous fluid type heat generator wherein, the heat generator comprises:

a housing assembly defining therein a fluid containing chamber for containing the viscous fluid and a heat receiving chamber for permitting heat exchanging fluid to flow therethrough;

a drive shaft rotatably supported by said housing assembly and rotationally driven by an external drive source, said drive shaft including a part thereof extending into said fluid containing chamber;

a rotor element mounted on said drive shaft to be rotated in said fluid containing chamber, the rotation of said rotor element applying a shearing action to the viscous fluid to generate heat;

a heat transmitting element arranged between said fluid containing chamber and said heat receiving chamber to transmit heat from the viscous fluid to the heat exchanging fluid;

a sealing element arranged around said drive shaft at a position adjacent to said fluid containing chamber to prevent the viscous fluid from leaking from said fluid containing chamber, wherein the method comprising the steps of:

applying a shearing action to the viscous fluid by rotation of the rotor element; and filling the viscous fluid in the fluid containing chamber at a volumetric filling rate in a range of from 50% to 70% with respect to an entire volume of the fluid containing chamber.

2. A method for generating heat with a viscous fluid type heat generator, wherein the heat generator comprises:

a housing assembly defining therein a generally disc-shaped fluid-containing chamber for containing viscous fluid and an adjacent flat heat-receiving chamber for permitting heat-exchanging fluid to flow therethrough;

an axial drive shaft rotatably supported by said housing assembly and rotationally driven by an external drive source, said drive shaft including an end projection thereof extending into said housing assembly;

a rotor element mounted on the end projection of said drive shaft to be rotated in said disc-shaped fluid-containing chamber, the rotor element having a pair of disc-like areas and a circumference arranged between the pair of disc-like areas, the rotation of said rotor element applying a shearing action to the viscous fluid to generate heat at least at the pair of disc-like areas;

a heat-transmitting element arranged between said disc-shaped fluid-containing chamber and said flat heat-receiving chamber to transmit heat from the viscous fluid to the heat-exchanging fluid; and, a sealing element arranged around said drive shaft at a position axially adjacent to said end projection of said drive shaft to prevent the viscous fluid from leaking from said disc-shaped fluid chamber wherein the method comprising the steps of:

applying a shearing action to the viscous fluid by rotation of the rotor element; and filling the viscous fluid containing chamber at a volumetric filling rate in a range of from 50% to 70% with respect to an entire volume of the fluid containing chamber.

3. The method according to claim 2, wherein said fluid containing chamber further includes an additional fluid containing chamber arranged adjacent to said fluid chamber in which heat is generated, fluidly communicating with said chamber in which heat is generated.

4. The method according to claim 3, whrein the volume of said fluid containing chamber and said additional fluid containing chamber of said viscous fluid type heat generator, except for the volume filled with the viscous fluid, is filled with non-oxidizing gas.

5. The method according to claim 4, wherein said non-oxidizing gas filling said fluid containing chamber comprises at least one member selected from the group consisting of nitrogen, carbon dioxide, helium, neon, and argon.

* * * * *